US006102216A

United States Patent [19]

Frank

[11] Patent Number: 6,102,216

[45] Date of Patent: Aug. 15, 2000

[54] ATTIRE ORGANIZER

[76] Inventor: Monty S Frank, 5460 Amby Dr., San Jose, Calif. 95124

[21] Appl. No.: 09/268,487

[22] Filed: Mar. 11, 1999

[51] Int. Cl.[7] ..... A47F 7/02; A47F 7/19; A47F 3/14

[52] U.S. Cl. ..... 211/85.3; 211/85.2; 211/126.15

[58] Field of Search ..... 211/85.3, 85.2, 211/126.15, 106.01, 85.17, 94.01, 36, 37, 34

[56] References Cited

U.S. PATENT DOCUMENTS

| | | | |
|---|---|---|---|
| D. 44,539 | 8/1913 | Nenno | 211/36 X |
| 1,270,817 | 7/1918 | Hammond | 211/36 X |
| 1,285,455 | 11/1918 | Stockov | 211/85.3 |
| 1,353,974 | 9/1920 | Smith | 211/85.3 |
| 2,077,458 | 4/1937 | Chesnut, Jr. | 211/85.3 X |
| 2,143,119 | 1/1939 | Waring | 211/85.3 |
| 2,633,995 | 4/1953 | Edelheit | 211/85.3 |
| 2,774,481 | 12/1956 | Sievers et al. | 211/85.3 |
| 3,355,231 | 11/1967 | Kegel | 211/126.15 X |
| 3,478,890 | 11/1969 | Allsop | 211/37 |
| 3,539,052 | 11/1970 | Bellock | 211/37 |
| 3,570,679 | 3/1971 | Edson | 211/47 |
| 3,784,269 | 1/1974 | Frenkel | 312/136 |
| 4,463,684 | 8/1984 | Klungle et al. | 211/126.15 X |
| 4,616,754 | 10/1986 | Heinzl et al. | 211/126.15 X |
| 4,981,224 | 1/1991 | Rushing | 211/126 |
| 5,172,816 | 12/1992 | Kline et al. | 211/37 |
| 5,542,758 | 8/1996 | Brown | 211/85.3 X |
| 5,636,751 | 6/1997 | Frank | 211/36 |

*Primary Examiner*—Daniel P. Stodola
*Assistant Examiner*—Erica B. Harris
*Attorney, Agent, or Firm*—Robert S. Smith

[57] ABSTRACT

A shelf rack such as for storing both men's and women's shoes including a base panel, normally resting on a horizontal surface, two side panels joined by a joining panel, and a stack of shelf panels supported by either grooves or studs in the side panels. Support by studs permits selection of the angle of the shelf panels with the horizontal plane. Blocks removably secured on the outside surface of either side panel has an array of pegs. With the blocks oriented in one position, the pegs are used for hanging shoes with high heels. The blocks oriented in another position, the pegs are retracted to permit convenient storage of the rack. A tie panel is removably mounted by hinges on an outside surface of a side panel. The tie panel has a tie bar on an inside surface so that the tie panel may be closed against the side panel to secure the ties when required or the tie panel may be swung back to provide accessibility to the ties.

12 Claims, 2 Drawing Sheets

ATTIRE ORGANIZER

FIELD OF THE INVENTION

This invention is related to transportable racks for storing articles of attire, particularly shoes, jewelry and ties.

PRIOR ART AND INFORMATION DISCLOSURE

The typical shoe rack for storing men's and women's shoes in the home is a rack that is laid out on a closet floor and permits storage of the shoes as single rows. An important problem for couples living in cramped living quarters such as studio apartments is efficient use of space available for storing clothes, particularly shoes. The shoe racks that are commonly used often occupy a large amount of floor space in the closet or the corner of the room or under the bed. The occupants in some homes simply deposit their shoes on the closet floor in a disorderly array. The job of selecting or finding the appropriate shoes is tedious and irksome, especially when the man and women of the house are required to keep their shoes in the same closet or area.

U.S. Pat. No. 3,539,052 to Bellock discloses a rack of forms wherein a shoe slips over each form. The rack of this invention occupies appreciably more floor space for a given capacity than the rack of the present invention. The fixed shoe forms attachable to the stand accommodate only a limited range of shoe sizes.

U.S. Pat. No. 3,478,890 to Allsop discloses a shoe rack including an expandable frame for each shoe and mounted on a lazy suzan. The arrangement of this construction does make optimum use of space for the rack compared to the rack of the present invention.

U.S. Pat. No. 4,981,224 to Rushing discloses a stacking tray display in which each tray is supported on a lower neighboring tray by four tube legs The construction of this invention enabling the user to stack racks is more expensive than the rack of the present invention.

U.S. Pat. No. 5,172,816 to Kline discloses a pair of tubes for supporting shoes and a support that permits distance between the tubes to accommodate various shoe sizes. The adjustment does not provide for simultaneously storing a range of shoe sizes nor does it accommodate variations in style such as the differences between men's and womens" shoes.

U.S. Pat. No. 5,636,751 to Frank discloses a shelf rack for shoes including a stack of shelf angles each shelf angle being a pair of rectangular panels joined along a common edge and each shelf angle having a pair of bar members adapted for hanging shoes with high heels.

None of the foregoing references disclose arrangements that are particularly suited to storing other items of attire such as jewelry, ties or belts.

SUMMARY

It is an object of this invention to provide a rack that is convenient for storing shoes, ties, belts and jewelry.

It is another object of the invention that the rack be readily transportable for the convenience of travelling individuals or groups of individuals.

It is another object of this invention that the rack be convertible from one usage such as storing shoes to another usage such as storing shirts, handkerchiefs, etc.

This invention is directed toward a central panel having one edge joined perpendicularly to a side panel and an opposite edge joined perpendicularly to another side panel.

A plurality of shelf panels parallel to one another is provided with one edge of each panel supported perpendicularly against the surface of one side panel and an opposite edge of each shelf panel supported perpendicularly against the opposite side panel.

In one embodiment, a side edge of each shelf is supported in a groove formed in the side panel opposite the parallel edge supported in a groove in the opposite panel.

In another embodiment, the edges of the shelf panel are supported by a pair of pegs in each side panel. This embodiment provides that the shelf panel can be supported in a selected one of inclinations and selected spacing between panels.

In one embodiment, the top panel is a box, preferably with a lid and a bottom panel that is larger than the lid and extends outside the width of the box so that the box can be readily removed from the rack or slid into position as the top shelf of the rack. The lid is preferably a clear plastic panel and the box is compartmentalized so that the contents of the box such as jewelry can be viewed from above the box without opening the lid. The lid is lockable.

In yet another embodiment, a rack for ties is provided including a "tie" panel with a tie bar along a top edge of the tie panel. The "tie" panel may be hung by hinges against a side panel outside the rack or detached from the rack and hung on the inside of a closet. The ties hanging on the bar are readily selectable and removable from the bar. When the "tie" panel is closed against the outside surface of the side panel, The ties are secured to the tie bar by a foam bar.and covered in preparation for transportation of the rack.

In still another embodiment, a bar is removably and horizontally mounted on the outside of the rack in one orientation where pegs in the bar are oriented to permit hanging shoes on the pegs. When the bar is mounted in another orientation, the pegs are oriented downward so that the rack occupies less space.

Figure 1:
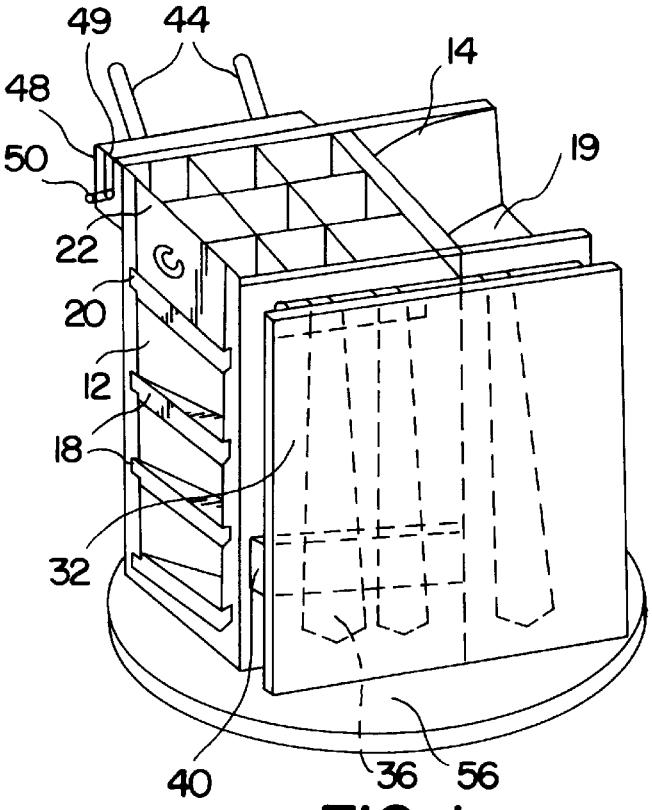
FIG. 1 is a perspective assembly view of the invention.
Figure 2:
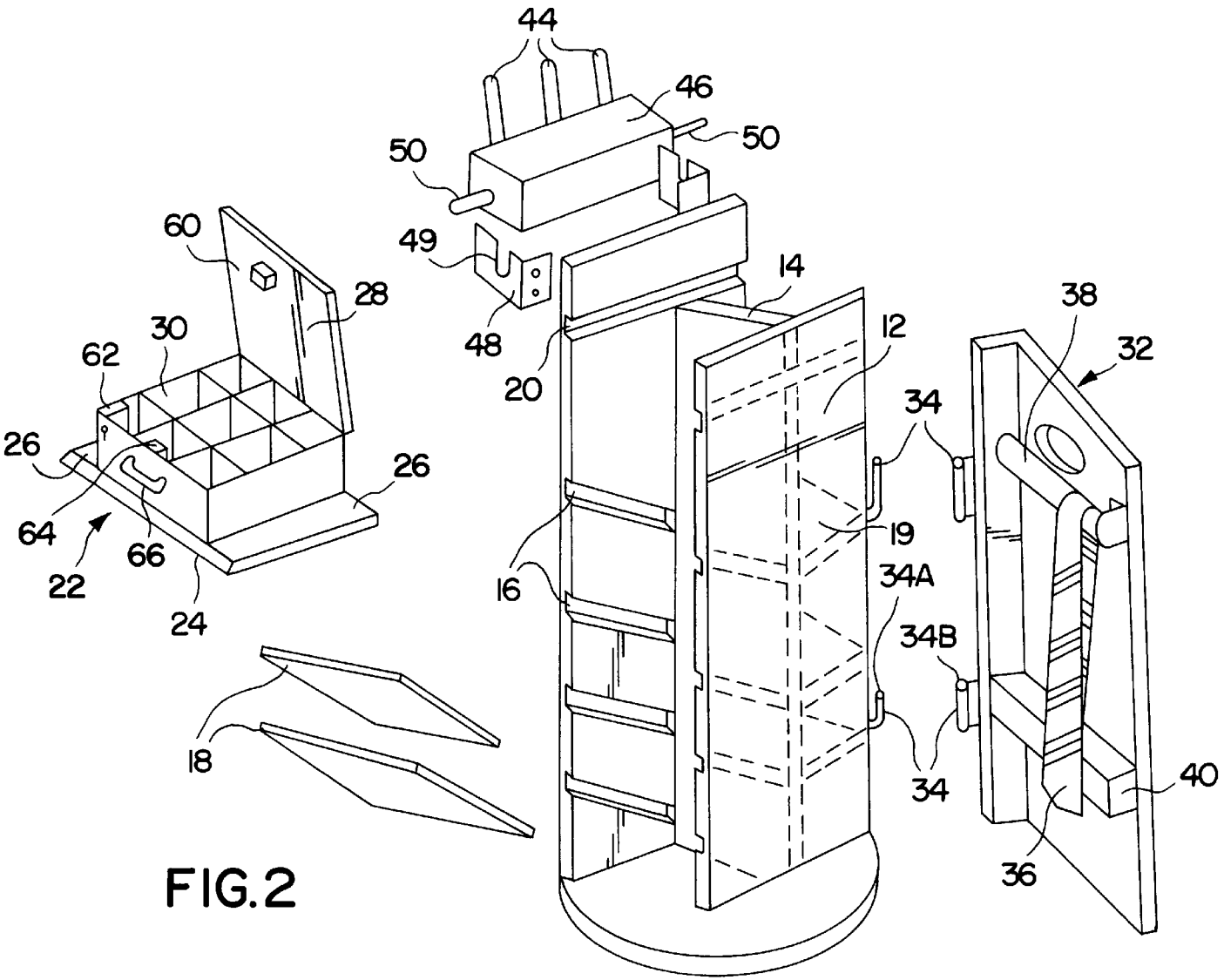
FIG. 2 is an exploded view of FIG. 1.

DESCRIPTION OF ILLUSTRATIVE EMBODIMENTS:

Turning now to a discussion of the drawings, FIG. 1 is an assembly perspective view of the attire rack 10 of this invention and FIG. 2 is an exploded view of FIG. 1. There are shown two side panels 12 joined perpendicularly by a joining panel 14, The side panels 12 have an array of parallel grooves 16 into which shelves 18 are slidably positioned. The grooves 16 are inclined and spaced to permit sliding shoes in the spaces between the shelves but a top groove 20 is horizontal so that a jewelry box 22 of this invention may be slid into the top pair of grooves 20. Jewelry box 22 is shown in FIG. 2 having a bottom 24 with edges 26 which are extended to permit engagement with top horizontal grooves 20. The jewelry box has compartments 30. The jewelry box 22 has a lid 28 hingably attached to the drawer 22 and is preferably a clear plastic to view the entire contents of the drawer without opening the drawer. The drawer may be locked into the rack by lock 62 and the lid may be locked closed by lock 64 engaging latch 60. A handle 66 is provided so that the jewelry box 22 may be separated from the rack 10 and carried like a satchel or positioned at another location (such as a dresser top) when required.

The rack is further equipped with a "tie" panel which is removably hingably attached to the edge of side panel 12 by a pair of hinges 34. Each hinge 34 has a male member 34A and a female member 34B so that the "tie" panel can be separated from the rack and hung (e.g.) in a closet, hung open on the rack 10 to provide accessibilty to the ties hung on tie bar 38 or closed against the side panel 12 as shown in FIG. 1 for convenience in transporting the entire rack with tie panel attached. The ends of the ties are secured between the side panel 12 and a foam pad 40 fastened to the tie panel 32 to prevent the ties from sliding off the tie bar 38 when the rack 10 is being transported.

Figure 3:
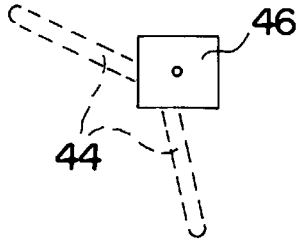
FIG. 3 illustrates orientations of the array of pegs mounted on a block.

FIGS. 1 and 2 also show an array of pegs 44 aligned in an elongated bar 46 and extending from the side panel 12 for hanging additional items such as high heel shoes. As shown to best advantage in the exploded view of FIG. 2, the bar 46 is supported by a pin 50 on each end of bar 46 that slids engagingly into a slot in bracket 48. In one orientation (shown in FIG. 1) the pegs are oriented substantially horizontally for engaging shoes. In another orientation of the bar, illustrated in FIG. 3 the bar is oriented such that the pegs point downward thereby providing that the overall width of the rack is reduced when it is desired to locate the rack in a confine space such as a closet. FIG. 3 shows in phantom the two orientations of the bar 46.

Figure 4:
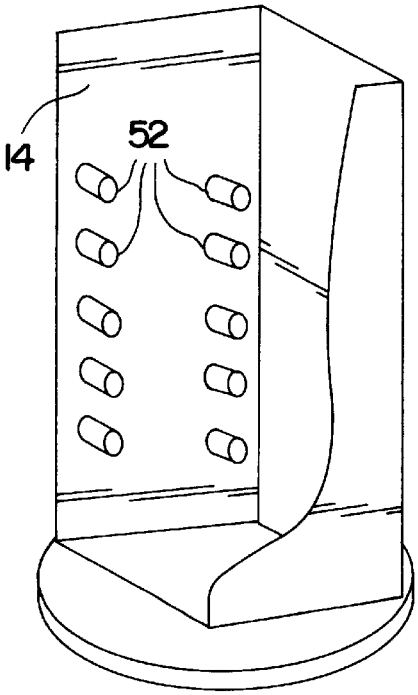
FIG. 4 shows vertical columns of studs in place of grooves to support the shelves.
Figure 5:
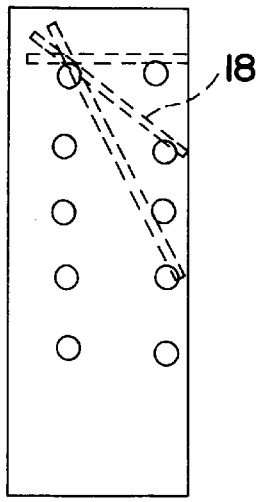
FIG. 5 shows various inclinations provided by the vertical rows of studs shown in FIG. 4.

FIGS. 4 and 5 shows one side panel cutaway to illustrate another embodiment where two rows of studs 52 in each side panel are used in place of grooves 16 (shown in FIG. 1) to support the shelves 18. As shown in FIG. 5, support of the shelves with the studs 52 permits selection of any one of several inclinations of the shelves 18 and spacing between shelves, Shelves 18 are shown in phantom in FIG. 5.

Variations and modifications of the invention may be contemplated after reading the specification and studying the drawings that are within the scope of the invention.

For example, the rack may be mounted on a revolvable platform 56 as shown in FIG. 1.

The rack may be built having one stack of shelves 18 on only one side of joining panel 14 or, as shown in FIGS. 1 and 2, with one stack of shelves 18 on one side of joining panel 14 and a second stack of shelves 19 on the opposite side of joining panel 14

In view of these and other modifications which include features of the invention, I therefore wish to define the scope of my invention by the appended claims.

I claim:

1. A rack for storing articles of attire including a collection of adornments, said rack arranged to enable a user to hand carry, when required, said collection of adornments separate from said articles of attire, said rack comprising:

a joining panel (14) having a pair of straight parallel edges;

a pair of side panels;

each side panel having an inside surface joined perpendicularly to one of said straight parallel edges respectively and operably arranged to provide that said inside surface of one side panel faces said inside surface of another side panel of said pair of side panels;

a first stack of shelves;

a base panel joined to an edge of said joining panel and said side panels providing that, when said base panel is supported horizontally, said joining panel and said side panels are vertical;

means (16,52) for supporting said first stack of shelves (18) wherein said shelves of said first stack are parallel to and spaced from one another with one edge of each shelf of said first stack against said inside surface of one side panel and opposite another edge of said each shelf of said first stack against said inside surface of said another side panel and a third edge of each said shelf of said first stack of shelves against one side of said joining panel;

a box (22) having four sides joined and a bottom panel (24) arranged to form said box;

a means (20) for slidably supporting said box at a top end of said first stack of shelves spaced from a top shelf of said first stack of shelves;

said bottom panel having edges (26) which are extended to permit engagement with said means (20) for supporting in said side panels;

said box having at least one partition forming a plurality of compartments (30);

a lid (28) hingably attached over an open top of said box (22);

a handle mounted on a front side of said box whereby a user is enabled to deposit said collection of adornments in said box and withdraw said box from said rack and carry said box by grasping said handle;

an elongated bar (46) having one flat surface;

means for rotatable supporting said elongated bar with said flat surface against an outside surface of one of said side panels (12) perpendicular to said joining panel (14) and with one end of said elongated bar proximal to said joining panel; and an array of pegs (44) aligned in said elongated bar (46) and extending away from the side panel (12).

2. The rack of claim 1 which further comprises:

a second stack of shelves and;

means for supporting said second stack of shelves (19) wherein said shelves of said second stack are parallel to and spaced from one another with one edge of each shelf of second stack against said inside surface of one side panel and opposite another edge of said each shelf of said first stack against said inside surface of said another side panel and a third edge of each said shelf of said second stack of shelves against another side of said joining panel.

3. The tie rack of claim 2 wherein said means of supporting said second stack of shelves comprises an array of pairs of parallel grooves in said inside surfaces of said side panels; and one groove of each pair of grooves being in one inside surface of one said side panel and another groove of said each pair of grooves being in said inside surface of said other side panel.

4. The rack of claim 1 wherein said lid is transparent enabling a user to examine contents of said box when said lid is closed.

5. The rack of claim 1 which further comprises a first lock (64) for locking said lid onto said box.

6. The rack of claim 5 which further comprises a second lock (62) for locking said box onto said rack.

7. The rack of claim 1 wherein said means of said first stack of shelves (20) comprises:

a first row of studs mounted on said inside surface of each side panel arranged proximal to and along said edge of said joining panel and a second row of studs mounted on said inside surface of said side panel arranged proximal to and along an edge of said side panel distal from said joining panel;

each shelf of said first stack of shelves being supported on one stud of said first row of studs of each side panel and another stud of said second row of studs of each said side panel providing that an inclination of each said shelf is selectable by selecting four studs of said first and second rows of studs for supporting said shelf.

8. The rack of claim 1 wherein said means for supporting said elongated block comprises:

a pair of brackets, each bracket (48) with a slot (49) and secured to said outside surface spaced from one another;

a pair of pins, one pin (50) on each end of said elongated block and extending from said block; and each pin sliding engaging into one said slot (49) respectively providing that, in one orientation of said block with said flat surface against said outside surface of said side panel, the pegs are oriented for engaging shoes and in another orientation of the block, said block is oriented with the pegs pointing in a direction reducing the overall width of the rack.

9. The rack of claim 1 which further comprises:

a tie panel having one edge engaged by a plurality of hinges to a vertical edge of one side panel, said edge of said side panel being oriented vertically when said rack is supported with said base panel horizontal;

each hinge (34) having a male member (34A) and a female member (34B) providing that said tie panel is separable from said rack and;

a tie bar secured to an inside surface of said tie panel operably arranged to permit hanging ties on said tie bar;

wherein said rack provides accessibilty to ties hung on said tie bar (38) when said tie panel is swung away from said side panel and securing said ties on said tie bar when said tie panel is closed against said side panel (12).

10. The rack of claim 9 which further comprises a foam pad (40) fastened to said inside surface of said tie panel (32) arranged to prevent said ties hanging from said tie bar from sliding off said tie bar (38).

11. The tie rack of claim 1 wherein said means of supporting said first stack of shelves comprises an array of pairs of parallel grooves in said inside surfaces of said side panels; and one groove of each pair of grooves being in one inside surface of one said side panel and another groove of said each pair of grooves being in said inside surface of said other side panel.

12. A rack for storing articles of clothing which comprises:

a joining panel (14) having a pair of straight parallel edges;

a pair of side panels;

each side panel having an inside surface joined perpendicularly to one of said straight parallel edges respectively and operably arranged to provide that said inside surface of one side panel faces said inside surface of another side panel of said pair of side panels;

a first stack of shelves;

a base panel joined to an edge of said joining panel and said side panels providing that, when said base panel is supported horizontally, said joining panel and said side panels are vertical;

means wherein said shelves of said first stack are parallel to and spaced from one another with one edge of each shelf of said first stack against said inside surface of one side panel and opposite another edge of said each shelf of said first stack against said inside surface of said another side panel and a third edge of each said shelf of said first stack of shelves against one side of said joining panel;

a box (22) having four sides joined and a bottom panel (24) arranged to form said box;

a means for slidably supporting said box at a top end of said first stack of shelves spaced from a top shelf of said first stack of shelves;

said bottom panel having edges (26) which are extended to permit engagement with said means (16, 52) for supporting in said side panels;

said box having at least one partition forming a plurality of compartments (30);

a lid (28) hingably attached over an open top of said box (22)

a second stack of shelves;

means for supporting said second stack of shelves (19) wherein said shelves of said second stack are parallel to and spaced from one another with one edge of each shelf of said second stack against said inside surface of one side panel and opposite another edge of said each shelf of said first stack against said inside surface of said another side panel and a third edge of each said shelf of said second stack of shelves against another side of said joining panel;

said lid is transparent enabling that a user to examine contents of said box when said lid is closed;

a first lock (64) for locking said lid onto said box;

a second lock (62) for locking said box onto said box on to said rack;

a front side of said box has a handle to permit a user to carry said box when said box is withdrawn from said rack;

an elongated block (46) having one flat surface;

means for supporting said elongated block with said flat surface against an outside surface of one of said side panels (12) perpendicular to said joining panel (14) and with one end of said elongated block proximal to said joining panel;

an array of aligned pegs (44) having one end secured in said elongated block (46) and extending away from the side panel (12);

a pair of brackets, each bracket (48) with a slot and secured to said outside surface spaced from one another;

a pair of pins; one pin 50 on each end of said elongated block (46) and extending from said block;

each pin slidingly engagingly into one said slot (49) respectively that, in one orientation of said block with said flat surface against said outside surface of said side panel, the pegs are oriented for engaging shoes and in another orientation of the block, said block is oriented with the pegs pointing in a direction reducing the overall width of the rack;

a tie panel having one edge engaged by a plurality of hinges to a vertical edge of one side panel, said edge of said side panel being oriented vertically when said rack is supported with said base panel horizontal;

each hinge (34) having a male member (34A) and a female member (34B) hinge (34) having a male member (34A) and a female member (34B) providing that said tie panel is separable from said rack;

a tie bar secured to an inside surface of said tie panel operably arranged to permit hanging ties on said tie bar;

said rack providing accessibilty to ties hung on said tie bar (38) when said tie panel is swung away from said side panel and securing said ties on said tie bar when said tie panel is closed against said side panel (12);

a foam pad (40) fastened to said inside surface of said tie panel (32) arranged to prevent said ties hanging from said tie bar from sliding off said tie bar (38).

* * * * *